US012203475B2

(12) United States Patent
Alfayez et al.

(10) Patent No.: US 12,203,475 B2
(45) Date of Patent: Jan. 21, 2025

(54) MAGNETIC DRIVE SEALLESS PUMPS WITH STEAM JACKET

(71) Applicant: Saudi Arabian Oil Company, Dhahran (SA)

(72) Inventors: Luai Ahmad Alfayez, Dhahran (SA); Amer Azzam Dhafiri, Dhahran (SA); Yasser Mohammed Alshahrani, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 198 days.

(21) Appl. No.: 17/893,560

(22) Filed: Aug. 23, 2022

(65) Prior Publication Data

US 2024/0068477 A1 Feb. 29, 2024

(51) Int. Cl.

| | |
|---|---|
| ***F04D 13/02*** | (2006.01) |
| ***F04D 29/048*** | (2006.01) |
| ***F04D 29/40*** | (2006.01) |

(52) U.S. Cl.

CPC ..... *F04D 13/026* (2013.01); *F04D 29/048* (2013.01); *F04D 29/40* (2013.01)

(58) Field of Classification Search

CPC ..... F04D 13/026; F04D 29/048; F04D 29/40
See application file for complete search history.

(56) References Cited

U.S. PATENT DOCUMENTS

| | | | | | |
|---|---|---|---|---|---|
| 2,556,854 | A * | 6/1951 | Spears | B01F 33/4531 | 416/169 R |
| 2,949,333 | A * | 8/1960 | Lesinski | F16C 33/76 | 384/480 |
| 4,115,040 | A * | 9/1978 | Knorr | H02K 49/104 | 310/104 |
| 4,120,618 | A * | 10/1978 | Klaus | F04D 29/426 | 415/217.1 |
| 4,722,661 | A * | 2/1988 | Mizuno | F04D 13/026 | 417/420 |
| 4,890,988 | A * | 1/1990 | Kramer | H02K 49/106 | 417/372 |
| 5,017,102 | A * | 5/1991 | Shimaguchi | G21C 15/243 | 376/404 |
| 5,108,715 | A * | 4/1992 | Jekat | F04D 29/061 | 422/903 |
| 5,165,868 | A * | 11/1992 | Gergets | F04C 15/0069 | 417/420 |
| 5,263,829 | A * | 11/1993 | Gergets | F04C 15/0069 | 418/175 |

(Continued)

*Primary Examiner* — Charles G Freay
*Assistant Examiner* — Benjamin Doyle
(74) *Attorney, Agent, or Firm* — DINSMORE & SHOHL LLP

(57) ABSTRACT

A magnetic drive sealless pump may comprise a pump casing, assembly bearing housing, and a frame having a first open end coupled to the pump casing and a second open end coupled to the bearing housing. The frame is provide over an outer magnetic ring and a containment shell, and the frame comprises a steam inlet and a steam outlet. The steam inlet is positioned proximate to the containment shell and the outer magnetic ring to permit introduction of steam to an exterior of the containment shell and the outer magnetic ring. The bearing housing my comprise a second steam outlet arranged between a dry gas seal and a bearing isolator for draining water accumulation.

20 Claims, 2 Drawing Sheets

(56) References Cited

U.S. PATENT DOCUMENTS 5,288,213 A * 2/1994 Nasr ..... F04D 29/061 417/372
5,322,421 A * 6/1994 Hansen ..... F04C 15/0096 417/420
5,368,390 A * 11/1994 Gambrill ..... F16C 33/303 366/331
5,411,366 A * 5/1995 Rockwood ..... H02K 49/108 415/173.5
5,525,039 A * 6/1996 Sieghartner ..... F04D 13/026 417/244
5,569,024 A * 10/1996 Dummersdorf ..... F04C 15/0069 418/104
5,846,049 A * 12/1998 DuPuis ..... F04D 13/026 415/174.3
5,856,719 A * 1/1999 De Armas ..... H02K 49/06 310/104
6,056,520 A * 5/2000 Nguyen ..... F04D 29/026 417/423.12
6,293,773 B1 * 9/2001 Doberstein ..... F04D 13/027 417/420
6,558,139 B2 * 5/2003 Nguyen ..... F04D 7/02 417/423.12
6,997,688 B1 * 2/2006 Klein ..... F04D 29/126 417/420
7,001,063 B1 * 2/2006 Markle ..... B08B 9/032 366/168.1
7,249,939 B2 * 7/2007 Yanagihara ..... F04D 29/026 417/420
8,333,666 B2 * 12/2012 Ekberg ..... H02K 5/124 310/104
9,093,891 B2 * 7/2015 Zhang ..... H02K 49/106
9,841,026 B2 * 12/2017 Stinessen ..... F04D 1/06
10,801,309 B2 * 10/2020 Cunningham ..... F04D 13/083
2005/0019182 A1 * 1/2005 Klein ..... F04D 13/026 417/420
2020/0256339 A1 * 8/2020 Stuart ..... F04D 29/026
2022/0106960 A1 * 4/2022 Clark ..... F04D 29/586

* cited by examiner

MAGNETIC DRIVE SEALLESS PUMPS WITH STEAM JACKET

TECHNICAL FIELD

The present specification generally relates to magnetic drive sealless pumps and, more specifically, magnetic drive sealless pumps for pump utilizing steam jacketing principles to improve reliability and reduce the chance of solidification.

BACKGROUND

Magnetic drive sealless pumps are suitable to pump corrosive and dangerous liquids. When pumping such corrosive and dangerous liquids, some of the liquids may turn solid or transition into a solid phase due to temperature change during operation. For example, sulfur has a very narrow operating range at which it is a liquid and the sulfur will become very viscous when exceeding or going below this range. Improper control of molten sulfur temperature may adversely impact reliability of magnetic drive sealless pumps, as it impairs the effectiveness of the internal magnetic coupling, thereby resulting in seizure.

Accordingly, a need exists for improved magnetic drive sealless pump that inhibits solidification of the liquid and has improved reliability.

SUMMARY

In one embodiment, a magnetic drive sealless pump includes: a pump casing comprising a suction opening, a discharge opening, and a casing volute; an impeller provided in an interior volume of the pump casing; an impeller shaft supporting the impeller such that the impeller shaft is rotatable with the impeller; an inner magnetic ring provided on the impeller shaft such that the inner magnetic ring is rotatable with the impeller shaft, the inner magnetic ring comprising a coaxially arranged outward facing permanent magnet; a containment shell having an internal volume and being sealed against the pump casing such that the interior volume of the pump casing is in communication with the internal volume of the containment shell, the impeller shaft extending into the internal volume of the containment shell such that the containment shell is arranged around the inner magnetic ring; an outer magnetic ring arranged around an exterior of the containment shell, the outer magnetic ring comprising coaxially arranged inward facing permanent magnets that are attracted to the coaxially arranged outward facing permanent magnet of the inner magnetic ring such the inner magnetic ring rotates with the outer magnetic ring; a frame provided over the outer magnetic ring and containment shell, the frame having a first open end and a second open end, the first open end of the frame being coupled to the pump casing, the frame comprising a steam inlet and a steam outlet, the steam inlet positioned proximate to the containment shell to permit introduction of steam to the exterior of the containment shell and the outer magnetic ring; and a bearing housing attached to and enclosing the second open end of the frame, the bearing housing having a shaft at least partially extending into the second open end of the frame and being operatively coupled to the outer magnetic ring such that rotation of the shaft rotates the outer magnetic ring, the bearing housing further comprising a bearing isolator that rotatably supports the shaft and a dry gas seal arranged between the bearing isolator and the second open end of the frame, and wherein the bearing housing includes a second steam outlet positioned between the dry gas seal and the bearing isolator for draining water accumulation.

In another embodiment, a magnetic drive sealless pump includes: a pump casing comprising a suction opening, a discharge opening, and a casing volute; an impeller provided in an interior volume of the pump casing; an impeller shaft supporting the impeller such that the impeller shaft is rotatable with the impeller; an inner magnetic ring provided on the impeller shaft such that the inner magnetic ring is rotatable with the impeller shaft, the inner magnetic ring comprising a coaxially arranged outward facing permanent magnet; a containment shell having an internal volume and being sealed against the pump casing such that the interior volume of the pump casing is in communication with the internal volume of the containment shell, the impeller shaft extending into the internal volume of the containment shell such that the containment shell is arranged around the inner magnetic ring; a bush holder assembly supported by the containment shell that operatively couples the impeller shaft to the pump casing, the bush holder assembly comprising a rigid holder attached to the containment shell and one or more bearings attached to the rigid holder for rotatably supporting the impeller shaft such that the impeller shaft may rotate relative to the rigid holder within the one or more bearings; an outer magnetic ring arranged around an exterior of the containment shell, the outer magnetic ring comprising coaxially arranged inward facing permanent magnets that are attracted to the coaxially arranged outward facing permanent magnet of the inner magnetic ring such the inner magnetic ring rotates with the outer magnetic ring; a frame provided over the outer magnetic ring and containment shell, the frame having a first open end and a second open end, the first open end of the frame being coupled to the pump casing, the frame comprising a steam inlet and a steam outlet, the steam inlet positioned proximate to the containment shell to permit introduction of steam to the exterior of the containment shell and the outer magnetic ring; and a bearing housing attached to and enclosing the second open end of the frame, the bearing housing having a shaft at least partially extending into the second open end of the frame and being operatively coupled to the outer magnetic ring such that rotation of the shaft rotates the outer magnetic ring, the bearing housing further comprising a bearing isolator that rotatably supports the shaft and a dry gas seal arranged between the bearing isolator and the second open end of the frame, and wherein the bearing housing includes a second steam outlet positioned between the dry gas seal and the bearing isolator for draining water accumulation.

In yet another embodiment, a magnetic drive sealless pump includes a pump casing comprising a suction opening, a discharge opening, and a casing volute; an impeller provided in an interior volume of the pump casing; a impeller shaft supporting the impeller such that the impeller shaft is rotatable with the impeller; an inner magnetic ring provided on the impeller shaft such that the inner magnetic ring is rotatable with the impeller shaft, the inner magnetic ring comprising a coaxially arranged outward facing permanent magnet; a containment shell having an internal volume and including a flange portion that is sealed against the pump casing such that the interior volume of the pump casing is in communication with the internal volume of the containment shell, the impeller shaft extending into the internal volume of the containment shell such that the containment shell is arranged around the inner magnetic ring; a bush holder assembly supported by the containment shell that operatively couples the impeller shaft to the pump casing, the bush holder assembly comprising a rigid holder attached to the containment shell and one or more bearings attached to the rigid holder for rotatably supporting the impeller shaft such that the impeller shaft may rotate relative to the rigid holder within the one or more bearings; an outer magnetic ring arranged around an exterior of the containment shell, the outer magnetic ring comprising coaxially arranged inward facing permanent magnets that are attracted to the coaxially arranged outward facing permanent magnet of the inner magnetic ring such the inner magnetic ring rotates with the outer magnetic ring, the outer magnetic ring having one or more openings proximate to the exterior of the containment shell; a frame coupled to a side of the flange portion of the containment shell that is opposite the pump casing, such that the frame is provided over the outer magnetic ring and containment shell, the frame having a first open end and a second open end, the first open end of the frame being coupled to the pump casing, the frame comprising a steam inlet and a steam outlet, the steam inlet positioned proximate to the containment shell to permit introduction of steam to the exterior of the containment shell, the steam inlet being positioned in proximity to the one or more openings in the outer magnetic ring; and a bearing housing attached to and enclosing the second open end of the frame, the bearing housing having a shaft at least partially extending into the second open end of the frame and being operatively coupled to the outer magnetic ring such that rotation of the shaft rotates the outer magnetic ring, the bearing housing further comprising a bearing isolator that rotatably supports the shaft and a dry gas seal arranged between the bearing isolator and the second open end of the frame, and wherein the bearing housing includes a second steam outlet positioned between the dry gas seal and the bearing isolator for draining water accumulation.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
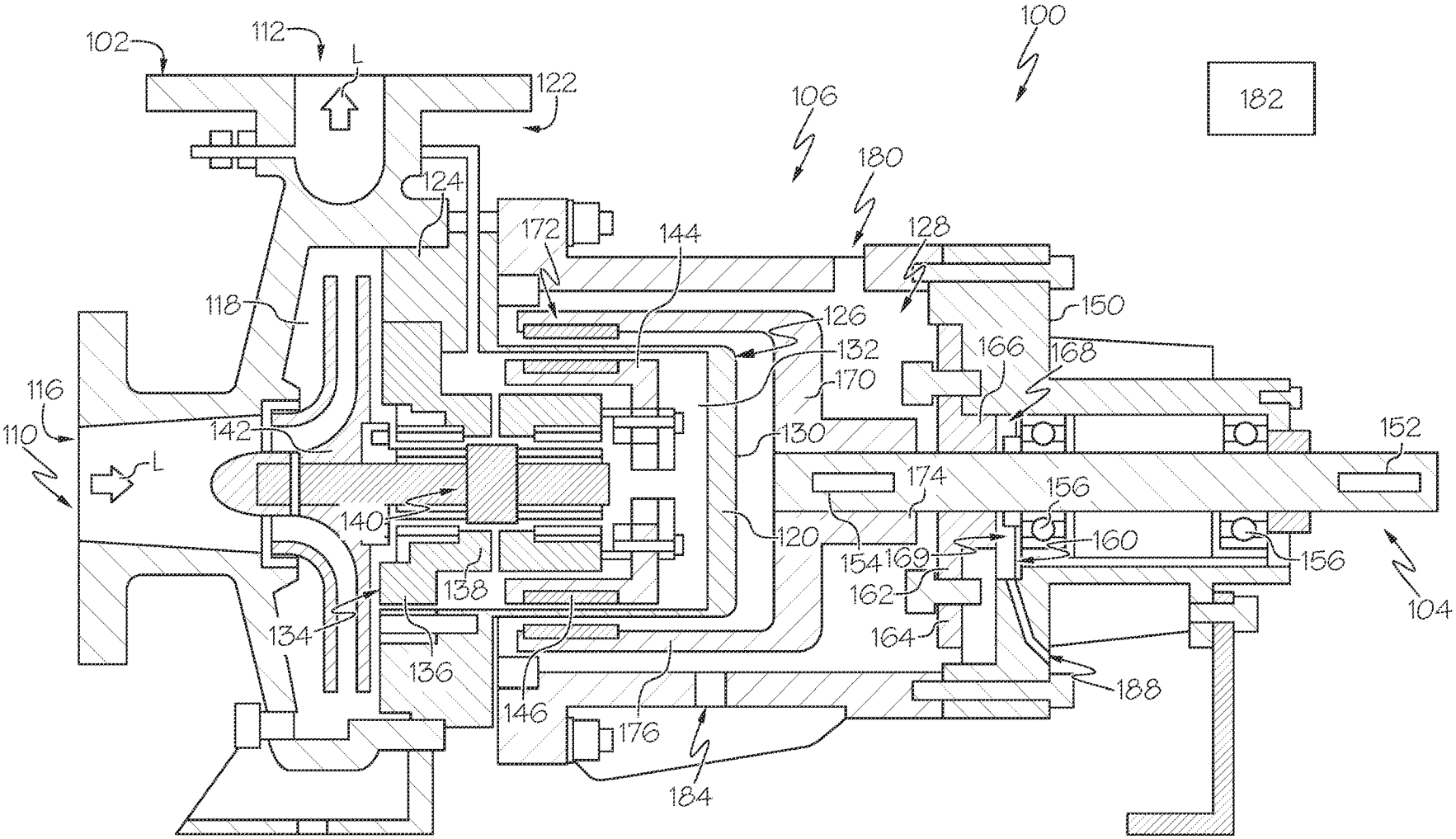
FIG. 1 schematically depicts a magnetic drive sealless pump, according to one or more embodiments shown and described herein.

Embodiments described herein are directed to a magnetic drive sealless pump having a containment shell, wherein a steam jacket is provided over an outer side of the containment shell, which will thereby reduce the chance of solidification inside the magnetic drive sealless pump, for example, when pumping sulfur.

The magnetic drive sealless pump includes a pump casing, a containment shell sealed against the pump casing to define an internal pump volume, a steam inlet provided proximate to the containment shell to permit introduction of steam to an exterior of the containment shell, and a pair of steam outlets. A first of the steam outlets is in fluid communication with the internal pump volume and the second of the steam outlets is provided between a dry seal and a bearing isolator. Various embodiments of the magnetic drive sealless pump and the operation of the magnetic drive sealless pump are described in more detail herein. Whenever possible, the same reference numerals will be used throughout the drawings to refer to the same or like parts.

Directional terms as used herein—for example up, down, right, left, front, back, top, bottom—are made only with reference to the figures as drawn and are not intended to imply absolute orientation.

Unless otherwise expressly stated, it is in no way intended that any method set forth herein be construed as requiring that its steps be performed in a specific order, nor that with any apparatus specific orientations be required. Accordingly, where a method claim does not actually recite an order to be followed by its steps, or that any apparatus claim does not actually recite an order or orientation to individual components, or it is not otherwise specifically stated in the claims or description that the steps are to be limited to a specific order, or that a specific order or orientation to components of an apparatus is not recited, it is in no way intended that an order or orientation be inferred, in any respect. This holds for any possible non-express basis for interpretation, including: matters of logic with respect to arrangement of steps, operational flow, order of components, or orientation of components; plain meaning derived from grammatical organization or punctuation, and; the number or type of embodiments described in the specification.

As used herein, the singular forms "a," "an" and "the" include plural referents unless the context clearly dictates otherwise. Thus, for example, reference to "a" component includes aspects having two or more such components, unless the context clearly indicates otherwise.

Referring now to FIG. 1, a magnetic drive sealless pump 100 (hereinafter, the pump 100) is illustrated according to one or more embodiments described herein. The pump 100 may generally include a casing 102 and a frame 106. The pump 100 may also include a motor assembly (not illustrated in FIG. 1) that is coupled to the casing 102 via the frame 106 and which drives the internal components of the pump 100. For example, as described below, the motor assembly may be operatively coupled to a pump shaft 104 that drives operation of the pump 100 as hereinafter described.

The casing 102 includes a suction flange 110 and a discharge flange 112. In the illustrated embodiment, both the suction flange 110 and the discharge flange 112 are provided as flange structures. In the illustrated embodiment, the suction flange 110 is provided on a front side 116 of the casing 102. The casing 102 defines an internal casing volume 118 that is in fluid communication with an opening of the suction flange 110 and an opening of the discharge flange 112.

The pump 100 includes a containment shell 120 provided on a rear side 122 of the casing 102. In the illustrated embodiment, the containment shell 120 includes a flange portion 124 and a cup portion 126 extending from the flange portion 124. The containment shell 120 is attached to the casing 102 such that a seal is formed between the containment shell 120 and the casing 102. In this manner, the containment shell 120 is sealed against the casing 102. Here, the flange portion 124 of the containment shell 120 is sealingly attached at the rear side 122 of the casing 102. In embodiments, the containment shell 120 is statically sealed against the casing 102 via a gasket or other sealing means. When the frame 106 is attached to the casing 102, the cup portion 126 of the containment shell 120 extends into an interior volume 128 of the frame 106, with an exterior surface 130 of the cup portion 126 being exposed to the environment, which may include jacketed steam as described below, within the interior volume 128 of the frame 106. As hereinafter described, the frame 106 houses the magnet coupling components of the pump 100.

The containment shell 120 also defines an internal shell volume 132. In the illustrated embodiment, the internal shell volume 132 extends through both the flange portion 124 and the cup portion 126 of the containment shell 120. When the containment shell 120 is attached to the rear side 122 of the casing 102, the internal casing volume 118 and the internal shell volume 132 together define an internal pump volume. The containment shell 120 may comprise a high-strength non-magnetic corrosion resistant alloy. As hereinafter described, the containment shell 120 functions as a containment shell and is a barrier between the internal pump volume and the interior volume 128 of the frame 106, with the exterior surface 130 of the containment shell 120 being exposable to materials introduced within the interior volume 128 of the frame 106 and inhibiting such materials from entering the internal pump volume.

The pump 100 includes a bush assembly 134 for operatively supporting various internal components of the pump 100 within the internal pump volume. The bush assembly 134 includes a mounting flange 136 and a rigid holder 138 extending from the mounting flange 136. In the illustrated embodiment, the mounting flange 136 of the bush assembly 134 is secured within an opening of the flange portion 124 of the containment shell 120, such that the rigid holder 138 of the bush assembly 134 extends towards the cup portion 126 of the containment shell 120 and is suspended within the internal shell volume 132 of the containment shell 120. In this manner, an annular and cup-shaped gap is defined between an exterior surface of the rigid holder 138 and an inner surface of the cup portion 126. In embodiments, the bush assembly 134 is attached to an inner surface of the internal shell volume 132 of the containment shell 120.

The pump 100 includes an impeller shaft 140 and an impeller 142 provided on the impeller shaft 140. The impeller shaft 140 is rotatably supported by the rigid holder 138 such that the impeller shaft 140 may rotate relative to the rigid holder 138. In embodiments, the impeller shaft 140 is coupled within a bore of the rigid holder 138 via one or more bushings, such that the impeller shaft 140 may rotate relative to and within the rigid holder 138 of the bush assembly 134.

The impeller shaft 140 has a bush attachment section that extends into the internal shell volume 132 of the containment shell 120 and which is rotatably supported by the rigid holder 138 via the bushings. The impeller shaft 140 also has stub shaft section extending from the bush attachment section and outward from the internal shell volume 132 of the containment shell 120, wherein the stub shaft section of the impeller shaft 140 supports the impeller 142 such that the impeller 142 is rotatable with the impeller shaft 140. The stub shaft section of the impeller shaft 140 extends into the internal casing volume 118 of the casing 102 such that the impeller 142 is positioned within the internal casing volume 118 of the internal pump volume. As described herein, rotation of the impeller 142 imparts energy to the fluid or liquid causing the pump 100 to operate.

The pump 100 includes a magnetic assembly comprising an inner magnetic ring 144 and an outer magnetic ring 170. The inner magnetic ring 144 is provided on the impeller shaft 140 such that the inner ring 144 is rotatable with the impeller shaft 140. The inner magnetic ring 144 is arranged coaxially over the impeller shaft 140 and suspended in the annular and cup-shaped gap defined between the exterior surface of the rigid holder 138 and the inner surface of the cup portion 126. In this manner, the containment shell 120 is provided over and arranged around the inner magnetic ring 144. The inner magnetic ring 144 includes a coaxially arranged outward facing permanent magnet 146. In embodiments, the coaxially arranged outward facing permanent magnet 146 of the inner magnetic ring 144 comprises an individual coaxially arranged outward facing permanent magnet that extends around a circumference of the inner magnetic ring 144. In other embodiments, the coaxially arranged outward facing permanent magnet 146 of the inner magnetic ring 144 comprises a plurality of coaxially arranged outward facing permanent magnets positioned around the circumference of the inner magnetic ring 144. In embodiments, the inner magnetic ring 144 or its coaxially arranged outward facing permanent magnet(s) is encapsulated with a protective sheathing.

The frame 106 comprises a bearing housing 150 that rotatably supports the pump shaft 104. A motor (not illustrated) may be operatively coupled to the pump shaft 104 such that activation of the motor rotates the pump shaft 104 clockwise or counterclockwise. In the illustrated example, the frame 106 includes a first open end, at which the frame 106 is coupled to the rear side 122 of the casing 102, and a second open end that is opposite the first open end, with the bearing housing 150 being attached to the second open end of the frame 106. In this manner, the bearing housing 150 encloses the second open end of the frame 106, thereby enclosing the interior volume 128 of the frame 106. The pump shaft 104 may be supported within the bearing housing 150 via bearings 156 which rotatably couple the pump shaft 104 to the bearing housing 150 such that the pump shaft 104 may rotate relative to the bearing housing 150. The pump shaft 104 includes a motor end 152, which may be engaged by the motor (not illustrated), and an opposite end 154 attached to the outer magnetic ring 170. As illustrated, the pump shaft 104 extends through the bearing housing 150, such that the motor end 152 of the pump shaft 104 is positioned exterior of the interior volume 128 and such that the opposite end 154 of the pump shaft 104 extends through the second end of the frame 106 and into the interior volume 128 of the frame 106. In embodiments, the frame 106 is coupled directly to the rear side 122 of the casing 102. In other embodiments, the containment shell 120 is sealingly attached to the rear side 122 of the casing 102 and the frame 106 is coupled directly a side of the containment shell 120 that is opposite the casing 102. For example, the flange portion 124 of the containment shell 120 may include a casing side and a motor side that is opposite the casing side, wherein the casing side of the flange portion 124 is sealed on the rear side 122 of the casing 102 and the frame 106 is attached to the motor side of the flange portion 124.

A bearing isolator 160 and a dry gas seal 162 are provided in the bearing housing 150. In embodiments, the dry gas seal 162 is a mechanical seal for sealing the interior volume 128 of the frame 106 and inhibiting ingression of steam therefrom into the bearing housing 150 or to the atmosphere surrounding the pump 100. The dry gas seal 162 will contain the steam within the interior volume 128 and minimize any potential leakage of steam to the atmospheric side of the pump 100 or into the bearing housing 150 to thereby prevent the steam from contaminating the oil or lubricant within the bearing housing 150. Also, as mentioned below, an outlet may be provided in the bearing housing 150 for drainage and the dry gas seal 162 minimizes the steam from escaping to the external atmosphere through that outlet.

The bearing isolator 160 and the dry gas seal 162 may be supported by the bearing housing 150 and abut or contact the pump shaft 104 so as to form a barrier between the bearing housing 150 and the pump shaft 104. Thus, the bearing isolator 160 and the dry gas seal 162 may operate to inhibit ingression of contaminants, which may be introduced in the interior volume 128 of the frame 106 as described herein, into the bearing block 150. The dry gas seal 162 is mounted to a face of the bearing housing 150 that covers the second open end of the frame 106, and the face of the bearing housing 150 is configured to receive the dry gas seal 162. In the illustrated embodiment, the dry gas seal 162 includes a flange portion 164 and an protruding portion 166 extending from the flange portion 164, and the bearing housing 150 includes a recess 168 configured to receive the protruding portion 166 of the dry gas seal 162. Here, the flange portion 164 is mounted to the face of the bearing housing 150 (e.g., via one more fasteners) such that the protruding portion 166 of the dry gas seal 162 extends into, and is set within, the recess 168 formed in the face of the bearing housing 150. In this manner, the dry gas seal 162 seals the bearing isolator 160 and other interior components of the bearing housing 150 from the interior volume 128 of the frame 106. Also, when the drive gas seal 162 is mounted to the bearing housing 150, a space 169 is defined between sidewalls of the bearing housing 150 that define the recess 168, the protruding portion 166 of the dry gas seal 162, and the bearing isolator 160, and water, steam, and/or bearing grease may accumulate in the space 169 as described herein.

As mentioned above, the magnetic assembly of the pump 100 includes the inner magnetic ring 144 and the outer magnetic ring 170, with the outer magnetic ring 170 being provided on the pump shaft 104 such that the outer magnetic ring 170 is rotatable with the pump shaft 104. The outer magnetic ring 170 comprises a coaxially arranged inward facing permanent magnet 172 that is attracted to the coaxially arranged outward facing permanent magnet 146 of the inner magnetic ring 144 such the inner magnetic ring 144 rotates with the outer magnetic ring 170 upon rotation of the pump shaft 104 via the motor 152. Thus, the coaxially arranged inward facing permanent magnet 172 and the coaxially arranged outward facing permanent magnet 146 may be arranged such that they are magnetically attracted to each other. Thus, the coaxially arranged inward facing permanent magnet 172 is arranged such that its inward oriented pole has opposite polarity of the outward oriented pole of the coaxially arranged outward facing permanent magnet 146.

The outer magnetic ring 170 includes a connection portion 174 and a cup portion 176. The connection portion 174 is secured to the opposite end 154 of the pump shaft 104. The coaxially arranged inward facing permanent magnet 172 is supported by the cup portion 176, for example, within an interior volume of the cup portion 176. When supported on the pump shaft 104, the cup portion 176 is suspended over at least a portion of the exterior surface 130 of the cup portion 126 of the containment shell 120, such that the coaxially arranged inward facing permanent magnet 172 of the outer magnetic ring 170 is oriented over, and in sufficient proximity to, the outward facing permanent magnet 146 of the inner magnetic ring 144. In this manner, rotation of the outer magnetic ring 170 causes rotation of the inner magnetic ring 144, even when separate by the containment shell 120. When the cup portion 176 of the outer magnetic ring 170 is suspended over the containment shell 120, an annular and cup-shaped gap is defined between the exterior surface 130 of the containment shell 120 and an inner surface of the cup portion 176. Openings or slots may be formed in the outer magnetic ring 170, for example, on the cup portion 176 thereof for providing a pathway for steam to pass through the outer magnetic ring 170 and contact the exterior surface 130 of the containment shell 120.

In embodiments, the coaxially arranged inward facing permanent magnet 172 comprises an individual coaxially arranged inward facing permanent magnet that extends around an inner circumference of the outer magnetic ring 170. In other embodiments, the coaxially arranged inward facing permanent magnet 172 comprises a plurality of inward facing permanent magnets positioned around the inner circumference of the outer magnetic ring 170. In embodiments, the outer magnetic ring 170 or its inner facing permanent magnet(s) is encapsulated with a protective sheathing.

The pump 100 is configured to provide a steam jacket on the exterior surface 130 of the containment shell 120 to control temperature of the material being pumped by the impeller 142. In this manner, the pump 100 is able to maintain the material being pumped in a liquid or fluid phase and inhibit its solidification which would otherwise impair operability of the pump 100. In embodiments, the frame 106 includes a steam inlet 180 through which steam may be introduced into the interior volume 128 of the frame 106. In embodiments, steam is introduced through the steam inlet 180 via a steam system 182. In embodiments, the frame 106 includes a steam outlet 184 through which steam, or liquid resulting therefrom, may exit the interior volume 128 of the frame 106. In embodiments, the steam system 182 is configured to also remove the steam (or resulting fluid) through the steam outlet 184.

The steam inlet 180 is positioned such that steam may be introduced into the interior volume 128 of the frame 106 and contact components of the pump 100 within the interior volume 128. For example, steam may be introduced into the interior volume 128 through the steam inlet 180 to contact the exterior surface 130 of the containment shell 120 and/or the outer magnetic ring 170. In embodiments, steam is introduced into the interior volume 128 of the frame 106 via the steam inlet 180 and then contacts the exterior surface 130 of the containment shell 120 by passing through slots or openings formed in the outer magnetic ring 170. The steam inlet 180 may be provided on the frame 106 at a location thereon that is proximate to the shell 120 and/or the outer magnetic ring 170 so as to optimize the heat transfer. In the illustrated example, the steam inlet 180 is provided on a top side of the frame 106. Similarly, the steam outlet 184 may be located in appropriate locations in order to optimize the heat transfer.

The pump 100 also includes the second steam outlet 188. As described above, the second steam outlet 188 provides drainage from within the bearing housing 150. During use, for example, the interior volume 128 of the frame 106 is filled with steam such that the dry gas seal 162 operates under a steam condition, and the second steam outlet 188 drains any steam that may pass there through into the space 169 to thereby avoid accumulation of water within the bearing housing 150. In embodiments, the second steam outlet 188 is formed at a position in the recess 168 of the bearing housing 150 between the bearing isolator 160 and the dry gas seal 162. For example, the second steam outlet 188 may be formed in the bearing housing 150 such that the second steam outlet 188 extends, from an exterior of the pump 100, into the space 169 defined between the bearing isolator 160 and the protruding portion 166 of the dry gas seal 162. In this manner, the second steam outlet 188 may operate to drain any water that may accumulate in the bearing isolator 160 and that may accumulate in the space 169 defined between the bearing isolator 160, the dry gas seal 162, and the recess 168 of the bearing housing 150.

Figure 2:
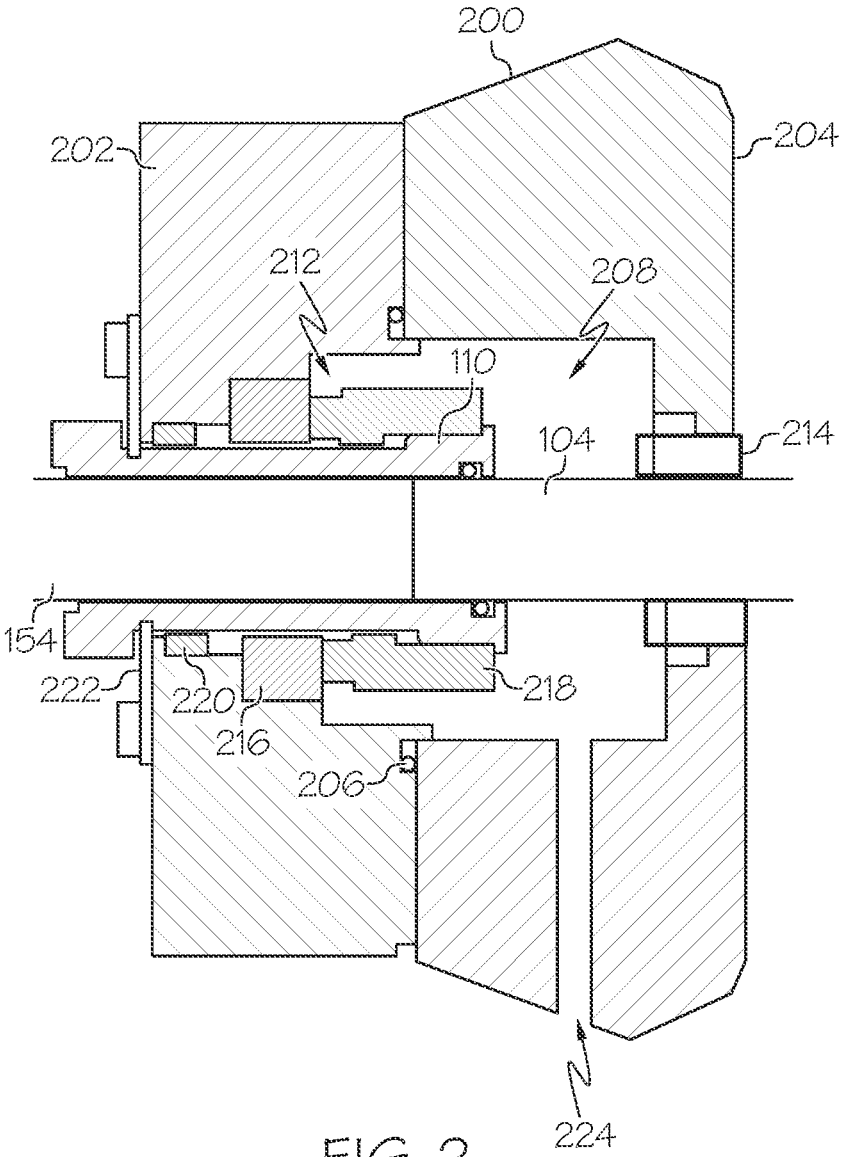
FIG. 2 is a partial side cross-sectional view of the pump shaft and bearing housing of a magnetic drive sealless pump, according to one or more embodiments shown and described herein.

FIG. 2 is a close-up cross-sectional view of an alternate bearing housing 200 for rotatably supporting the pump shaft 104 of the pump 100, according to one or more embodiments of the present disclosure. In the illustrated embodiment, the bearing housing 200 comprises a first portion 202 and a second portion 204. The second portion 204 may be removable from the first portion 202, or vice versa, to facilitate installation and/or repair, and a gasket or seal 206 may be provided between the first portion 202 and the second portion 204. A space 208 is defined within the bearing housing 200, and a bearing assembly 210 may be provided in the space 208 of the bearing housing 200 for rotatably coupling the shaft 104 to the bearing housing 200. As described above, a dry gas seal 212 and a bearing isolator 214 may also be provided in the bearing housing 200. In the illustrated embodiment, the dry gas seal 212 includes a stationary face 216 and a rotating face 218. Also in the illustrated embodiment, a seal bushing 220 and a setting plate 222 are provided about the bearing assembly 210 and the pump shaft 104. Also, a second steam outlet 224 is formed in the bearing housing 200 so as to provide drainage from the space 208 within the bearing housing 200. Thus, as previously described, the second steam outlet 224 drains any steam that may pass through the dry gas seal 212 and into the space 208 to thereby avoid accumulation of water within the bearing housing 200.

Embodiments of the pump 100 described herein may utilized to pump a corrosive and dangerous liquid L, such as sulfur. During such an example operation of the pump, a motor may be operatively coupled to the pump shaft 104 and the motor may be activated to thereby rotate the pump shaft 104 and the outer magnetic ring 170 that is coupled to the pump shaft 104. As described above, the inner magnetic ring 144 is attracted to the outer magnetic ring 170, such that rotation of the outer magnetic ring 170 via the pump shaft 104 correspondingly rotates the inner magnetic ring 144 and the impeller shaft 140 which is coupled to the inner magnetic ring 144, and rotation of the impeller shaft 140 correspondingly rotates the impeller 142 which is coupled to the impeller shaft 140. Rotation of the impeller 142 sucks the liquid L through the suction flange 110 and into the internal pump volume, and then discharges the liquid L out of the internal pump volume through an opening at the discharge flange 112.

From the above, it is to be appreciated that defined herein is a magnetic drive sealless pump that provides a steam jacket to the exterior of the containment shell to inhibit solidification of the fluid being pumped, such as in molten sulfur pump applications. The steam jacket enhances temperature control and stability of the fluid being pumped.

While particular embodiments have been illustrated and described herein, it should be understood that various other changes and modifications may be made without departing from the scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

It will be apparent to those skilled in the art that various modifications and variations can be made to the embodiments described herein without departing from the scope of the claimed subject matter. Thus, it is intended that the specification cover the modifications and variations of the various embodiments described herein provided such modification and variations come within the scope of the appended claims and their equivalents.

What is claimed is:

1. A magnetic drive sealless pump, comprising:

a pump casing comprising a suction opening, a discharge opening, and a casing volute;

an impeller provided in an interior volume of the pump casing;

an impeller shaft supporting the impeller such that the impeller shaft is rotatable with the impeller;

an inner magnetic ring provided on the impeller shaft such that the inner magnetic ring is rotatable with the impeller shaft, the inner magnetic ring comprising a coaxially arranged outward facing permanent magnet;

a containment shell having an internal volume and being sealed against the pump casing such that the interior volume of the pump casing is in communication with the internal volume of the containment shell, the impeller shaft extending into the internal volume of the containment shell such that the containment shell is arranged around the inner magnetic ring;

an outer magnetic ring arranged around an exterior of the containment shell, the outer magnetic ring comprising coaxially arranged inward facing permanent magnets that are attracted to the coaxially arranged outward facing permanent magnet of the inner magnetic ring such the inner magnetic ring rotates with the outer magnetic ring;

a frame provided over the outer magnetic ring and containment shell, the frame having a first open end and a second open end, the first open end of the frame being coupled to the pump casing, the frame comprising a steam inlet and a steam outlet, the steam inlet positioned proximate to the containment shell to permit introduction of steam to the exterior of the containment shell and the outer magnetic ring; and a bearing housing attached to and enclosing the second open end of the frame, the bearing housing having a shaft at least partially extending into the second open end of the frame and being operatively coupled to the outer magnetic ring such that rotation of the shaft rotates the outer magnetic ring, the bearing housing further comprising a bearing isolator that rotatably supports the shaft, the bearing isolator supported by the bearing housing and abutting the shaft, the bearing isolator positioned adjacent a bearing that rotatably supports the shaft, and a dry gas seal arranged between the bearing isolator and the second open end of the frame, and wherein the bearing housing defines a recess between the dry gas seal and the bearing isolator and includes a second steam outlet fluidly coupled to the recess and positioned between the dry gas seal and the bearing isolator for draining water accumulation from the recess.

2. The magnetic drive sealless pump of claim 1, wherein the coaxially arranged outward facing permanent magnet of the inner magnetic ring is fully encapsulated with a sheathing.

3. The magnetic drive sealless pump of claim 1, wherein the coaxially arranged inward facing permanent magnets of the outer magnetic ring are fully encapsulated with a sheathing.

4. The magnetic drive sealless pump of claim 1, wherein the containment shell comprises a high-strength non-magnetic corrosion resistant alloy.

5. The magnetic drive sealless pump of claim 1, wherein the containment shell is statically sealed against the casing via a gasket.

6. The magnetic drive sealless pump of claim 1, further comprising a bush holder assembly that operatively couples the impeller shaft to the pump casing, the bush holder assembly comprising a rigid holder attached to a surface defining the internal volume of the containment shell and one or more bearings attached to the rigid holder for rotatably supporting the impeller shaft such that the impeller shaft may rotate relative to the rigid holder within the one or more bearings.

7. The magnetic drive sealless pump of claim 1, wherein the coaxially arranged outward facing permanent magnet of the inner magnetic ring comprises a plurality of discrete magnets.

8. The magnetic drive sealless pump of claim 1, wherein the coaxially arranged outward facing permanent magnet of the inner magnetic ring comprises an individual magnet.

9. The magnetic drive sealless pump of claim 1, wherein the coaxially arranged inward facing permanent magnets of the outer magnetic ring comprise a plurality of discrete magnets.

10. The magnetic drive sealless pump of claim 1, wherein the coaxially arranged inward facing permanent magnets of the outer magnetic ring comprise an individual magnet.

11. The magnetic drive sealless pump of claim 1, wherein the outer magnetic ring includes a cup portion within which the containment shell extends.

12. The magnetic drive sealless pump of claim 1, wherein the containment shell includes a flange portion that is sealingly attached to the pump casing, and the frame is coupled to a side of the flange portion of the containment shell that is opposite the pump casing.

13. The magnetic drive sealless pump of claim 1, wherein the outer magnetic ring includes one or more openings proximate to the steam inlet of the frame and the containment shell.

14. A magnetic drive sealless pump, comprising:

a pump casing comprising a suction opening, a discharge opening, and a casing volute;

an impeller provided in an interior volume of the pump casing;

an impeller shaft supporting the impeller such that the impeller shaft is rotatable with the impeller;

an inner magnetic ring provided on the impeller shaft such that the inner magnetic ring is rotatable with the impeller shaft, the inner magnetic ring comprising a coaxially arranged outward facing permanent magnet;

a containment shell having an internal volume and being sealed against the pump casing such that the interior volume of the pump casing is in communication with the internal volume of the containment shell, the impeller shaft extending into the internal volume of the containment shell such that the containment shell is arranged around the inner magnetic ring;

a bush holder assembly supported by the containment shell that operatively couples the impeller shaft to the pump casing, the bush holder assembly comprising a rigid holder attached to the containment shell and one or more bearings attached to the rigid holder for rotatably supporting the impeller shaft such that the impeller shaft may rotate relative to the rigid holder within the one or more bearings;

an outer magnetic ring arranged around an exterior of the containment shell, the outer magnetic ring comprising coaxially arranged inward facing permanent magnets that are attracted to the coaxially arranged outward facing permanent magnet of the inner magnetic ring such the inner magnetic ring rotates with the outer magnetic ring;

a frame provided over the outer magnetic ring and containment shell, the frame having a first open end and a second open end, the first open end of the frame being coupled to the pump casing, the frame comprising a steam inlet and a steam outlet, the steam inlet positioned proximate to the containment shell to permit introduction of steam to the exterior of the containment shell and the outer magnetic ring; and a bearing housing attached to and enclosing the second open end of the frame, the bearing housing having a shaft at least partially extending into the second open end of the frame and being operatively coupled to the outer magnetic ring such that rotation of the shaft rotates the outer magnetic ring, the bearing housing further comprising a bearing isolator that rotatably supports the shaft, the bearing isolator supported by the bearing housing and abutting the shaft, the bearing isolator positioned adjacent a bearing that rotatably supports the shaft, and a dry gas seal arranged between the bearing isolator and the second open end of the frame, and wherein the bearing housing defines a recess between the dry gas seal and the bearing isolator and includes a second steam outlet fluidly coupled to the recess and positioned between the dry gas seal and the bearing isolator for draining water accumulation from the recess.

15. The magnetic drive sealless pump of claim 14, wherein the outer magnetic ring includes one or more openings proximate to the steam inlet of the frame and the containment shell.

16. The magnetic drive sealless pump of claim 14, wherein the coaxially arranged outward facing permanent magnet of the inner magnetic ring is fully encapsulated with a sheathing.

17. The magnetic drive sealless pump of claim 14, wherein the coaxially arranged inward facing permanent magnet of the outer magnetic ring is fully encapsulated with a sheathing.

18. The magnetic drive sealless pump of claim 14, wherein the containment shell comprises a high-strength non-magnetic corrosion resistant alloy.

19. The magnetic drive sealless pump of claim 1, wherein the containment shell is statically sealed against the casing via a gasket.

20. A magnetic drive sealless pump, comprising:

a pump casing comprising a suction opening, a discharge opening, and a casing volute;

an impeller provided in an interior volume of the pump casing;

an impeller shaft supporting the impeller such that the impeller shaft is rotatable with the impeller;

an inner magnetic ring provided on the impeller shaft such that the inner magnetic ring is rotatable with the impeller shaft, the inner magnetic ring comprising a coaxially arranged outward facing permanent magnet;

a containment shell having an internal volume and including a flange portion that is sealed against the pump casing such that the interior volume of the pump casing is in communication with the internal volume of the containment shell, the impeller shaft extending into the internal volume of the containment shell such that the containment shell is arranged around the inner magnetic ring;

a bush holder assembly supported by the containment shell that operatively couples the impeller shaft to the pump casing, the bush holder assembly comprising a rigid holder attached to the containment shell and one or more bearings attached to the rigid holder for rotatably supporting the impeller shaft such that the impeller shaft may rotate relative to the rigid holder within the one or more bearings;

an outer magnetic ring arranged around an exterior of the containment shell, the outer magnetic ring comprising coaxially arranged inward facing permanent magnets that are attracted to the coaxially arranged outward facing permanent magnet of the inner magnetic ring such the inner magnetic ring rotates with the outer magnetic ring, the outer magnetic ring having one or more openings proximate to the exterior of the containment shell;

a frame coupled to a side of the flange portion of the containment shell that is opposite the pump casing, such that the frame is provided over the outer magnetic ring and containment shell, the frame having a first open end and a second open end, the first open end of the frame being coupled to the pump casing, the frame comprising a steam inlet and a steam outlet, the steam inlet positioned proximate to the containment shell to permit introduction of steam to the exterior of the containment shell, the steam inlet being positioned in proximity to the one or more openings in the outer magnetic ring; and a bearing housing attached to and enclosing the second open end of the frame, the bearing housing having a shaft at least partially extending into the second open end of the frame and being operatively coupled to the outer magnetic ring such that rotation of the shaft rotates the outer magnetic ring, the bearing housing further comprising a bearing isolator that rotatably supports the shaft, the bearing isolator supported by the bearing housing and abutting the shaft, the bearing isolator positioned adjacent a bearing that rotatably supports the shaft, and a dry gas seal arranged between the bearing isolator and the second open end of the frame, wherein the bearing housing defines a recess between the dry gas seal and the bearing isolator and includes a second steam outlet fluidly coupled to the recess and positioned between the dry gas seal and the bearing isolator for draining water accumulation from the recess, and wherein the dry gas seal includes a flange portion and a protruding portion extending from the flange portion, the flange portion mounted to a face of the bearing housing covering the second open end of the frame and the protruding portion extending into the recess.

* * * * *